US009228800B2

(12) United States Patent
Holmes et al.

(10) Patent No.: US 9,228,800 B2
(45) Date of Patent: Jan. 5, 2016

(54) UNIVERSAL MAGAZINE MOUNTING SYSTEM

(71) Applicants: Frederick J. Holmes, Plainville, MA (US); Mark E. Jenkinson, Wilbraham, MA (US)

(72) Inventors: Frederick J. Holmes, Plainville, MA (US); Mark E. Jenkinson, Wilbraham, MA (US)

(73) Assignee: Present Arms Inc., Wilbraham, MA (US)

( * ) Notice: Subject to any disclaimer, the term of this patent is extended or adjusted under 35 U.S.C. 154(b) by 0 days.

(21) Appl. No.: 13/897,389

(22) Filed: May 18, 2013

(65) Prior Publication Data

US 2013/0318850 A1 Dec. 5, 2013

Related U.S. Application Data

(60) Provisional application No. 61/689,099, filed on May 30, 2012.

(51) Int. Cl.
*F41C 27/00* (2006.01)
*F41A 23/18* (2006.01)

(52) U.S. Cl.
CPC ..... *F41C 27/00* (2013.01); *F41A 23/18* (2013.01)

(58) Field of Classification Search
CPC ..... F41C 27/00; F41A 23/16; F41A 35/00; F41A 23/18
USPC ..... 42/87, 88, 90, 94, 95, 106; 89/1.4; 248/207, 231.9; 269/45; 446/85, 86
See application file for complete search history.

(56) References Cited

U.S. PATENT DOCUMENTS

| | | | | |
|---|---|---|---|---|
| 1,915,835 | A * | 6/1933 | Pajeau | 446/103 |
| 2,877,689 | A * | 3/1959 | Pribis | 89/37.04 |
| 3,987,579 | A * | 10/1976 | Palenik, III | 446/118 |
| 4,055,017 | A * | 10/1977 | Thompson | F41A 23/00 42/94 |
| 4,824,086 | A * | 4/1989 | Rickling et al. | 269/156 |
| 5,038,509 | A * | 8/1991 | Stephan | 42/95 |
| 5,375,905 | A * | 12/1994 | Flitter et al. | 297/15 |
| 5,503,276 | A * | 4/1996 | Pierce | 211/64 |
| 6,361,035 | B1 * | 3/2002 | Collins | 269/45 |
| 2003/0020224 | A1 * | 1/2003 | Murvine | 269/45 |
| 2003/0188567 | A1 * | 10/2003 | Garrett et al. | 72/454 |
| 2008/0034636 | A1 * | 2/2008 | Potterfield et al. | 42/94 |
| 2011/0101192 | A1 * | 5/2011 | Lee et al. | 248/346.03 |
| 2011/0173868 | A1 * | 7/2011 | Wilson | F41A 29/00 42/95 |
| 2012/0255212 | A1 * | 10/2012 | Werner | F41A 31/02 42/90 |

* cited by examiner

*Primary Examiner* — Bret Hayes
(74) *Attorney, Agent, or Firm* — Artero & Tormey; Pete Tormey; Michael Petrin

(57) ABSTRACT

A magazine mounting platform having at least one mounting fixture for insertion into the magazine compartment of a firearm thus securing the firearm in place. The magazine mounting fixture may include at least one dowel pin operable for insertion into receivers on the platform. Some embodiments may also include a rotational adapter which allows for a firearm mounted on the fixture to be rotated. Risers may be included to provide additional support for a firearm by securing in place a barrel or a stock. Some embodiments may include magazine mounts for M4 carbine type, AR rifle type or Model 1911 pistol type firearms.

7 Claims, 2 Drawing Sheets

UNIVERSAL MAGAZINE MOUNTING SYSTEM

PRIORITY

This application is a non-provisional patent application of U.S. Provisional Patent application 61/689,099 entitled "Universal Magazine Mounting System" filed on May 30, 2012 by the same inventor, which is incorporated by reference as if fully set forth herein.

BACKGROUND

The present invention relates generally to mounting systems for holing firearms for cleaning and maintenance. When cleaning or repairing a firearm it is important to have a secure way to grasp the firearm so that the parts of the weapon can be easily accessed.

SUMMARY

Disclosed herein is a magazine mounting platform having at least one mounting fixture for insertion into the magazine compartment of a firearm thus securing the firearm in place. The magazine mounting fixture may include at least one dowel pin operable for insertion into receivers on the platform. Some embodiments may also include a rotational adapter which allows for a firearm mounted on the fixture to be rotated. Risers may be included to provide additional support for a firearm by securing in place a barrel or a stock. Some embodiments may include magazine mounts for M4 carbine type, AR rifle type or Model 1911 pistol type firearms among others.

In certain embodiments a universal mounting system for firearms would operate by disposing a support structure into the compartment where a firearm's magazine would normally be located. The device thus comprises a tool-less, ergonomically designed system for the mounting and holding of magazine fed firearms on a plurality of interchangeable platforms for the cleaning, maintenance, repair, operational training, display, and storage of such firearms.

In some embodiments the system may include specifically designed platforms for a particular make and model of firearm. These embodiments may also incorporate a receiver to accommodate multiple and/or varying adapters, specific to the particular design of the desired firearm. The adapters may include stationary or fully rotational designs along with other means for ergonomic access to the firearm.

The construction and method of operation of the invention, however, together with additional objectives and advantages thereof will be best understood from the following description of specific embodiments when read in connection with the accompanying drawings.

DESCRIPTION

Generality of Invention

Figure 1:
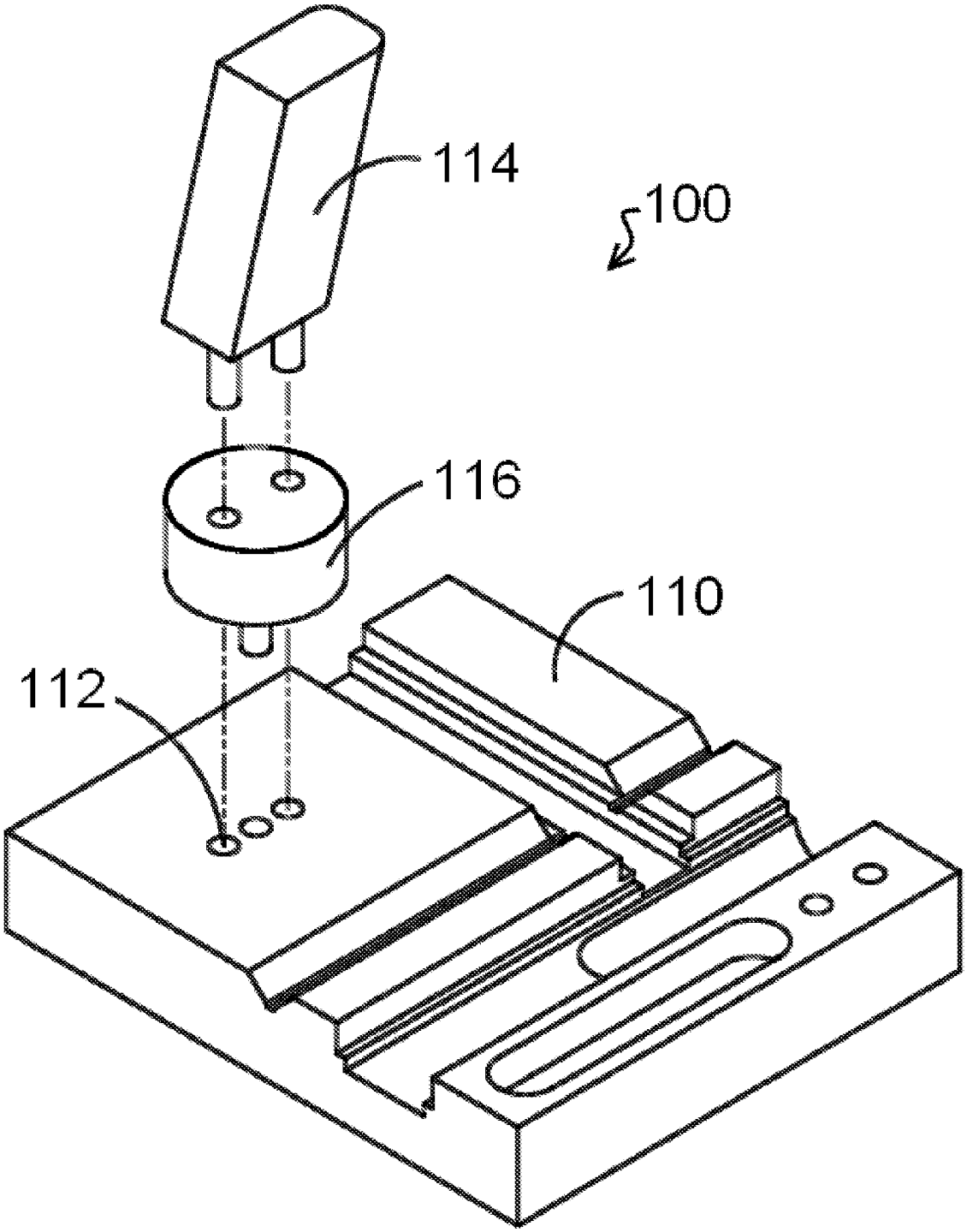
FIG. 1 is an illustration of certain aspects a universal magazine mounting system.

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention, and does not mean that those techniques are necessarily essential or would be preferred in all circumstances.

References to contemplated causes and effects for some implementations do not preclude other causes or effects that might occur in other implementations.

References to reasons for using particular techniques do not preclude other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention, and these variations would become clear to those skilled in the art after perusal of this application.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

DETAILED DESCRIPTION

FIG. 1 is an illustration of certain aspects a universal magazine mounting system 100. In FIG. 1 a platform 110 includes multiple cutouts with firearm-specific cuts and grooves for individual or multiple type firearms. The platform 110 includes a receiver 112 for holding a magazine mount 114. The magazine mount 114 is designed to fit into a firearm in the same manner as a detachable magazine would fit into the same firearm The magazine mount 114 also includes mounting appendages for securing the magazine mount 114 to the platform 110. The mounting appendages may be formed as short dowel pins for insertion into holes (or receivers) in the platform 110. In some embodiments multiple holes are disposed in the platform 110 to allow for the magazine mount 114 to positioned in multiple directions.

Some embodiments may also include a rotational adaptor 116 that allows for a firearm to be easily rotated and remain securely attached to the system. The rotational adapter 116 may have a single dowel pin for coupling to the platform 110 and, on the opposite side, two receivers for receiving dowel pins from a magazine mount 114. This provides for a rotational adaptor 116 to swivel about the platform 110 and still support the magazine mount 114.

The magazine mount 114 may be formed in a manner similar to conventional firearm magazines. For example and without limitation, the magazine mount may be an elongated rectangle offset to allow for angled insertion into a firearm. In addition, the magazine mount 114 may be curved to allow for insertion into different firearm magazines. The overall length and width of the magazine mount 114 may be determined from the specific manufacturer of a firearm allowing the magazine mount 114 to fit snugly and hold the weight of the firearm.

Many of the embodiments disclosed herein may be formed from machined metal, wood or plastic. One having skill in the art will appreciate that the parts of the system may also be constructed using injection molding or 3D printing provided that the material has enough strength to hold the weight of the firearm. Alternative embodiments may include compartments for holding magazines, firing pins, barrels, and other parts and tools needed for maintenance of a firearm.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
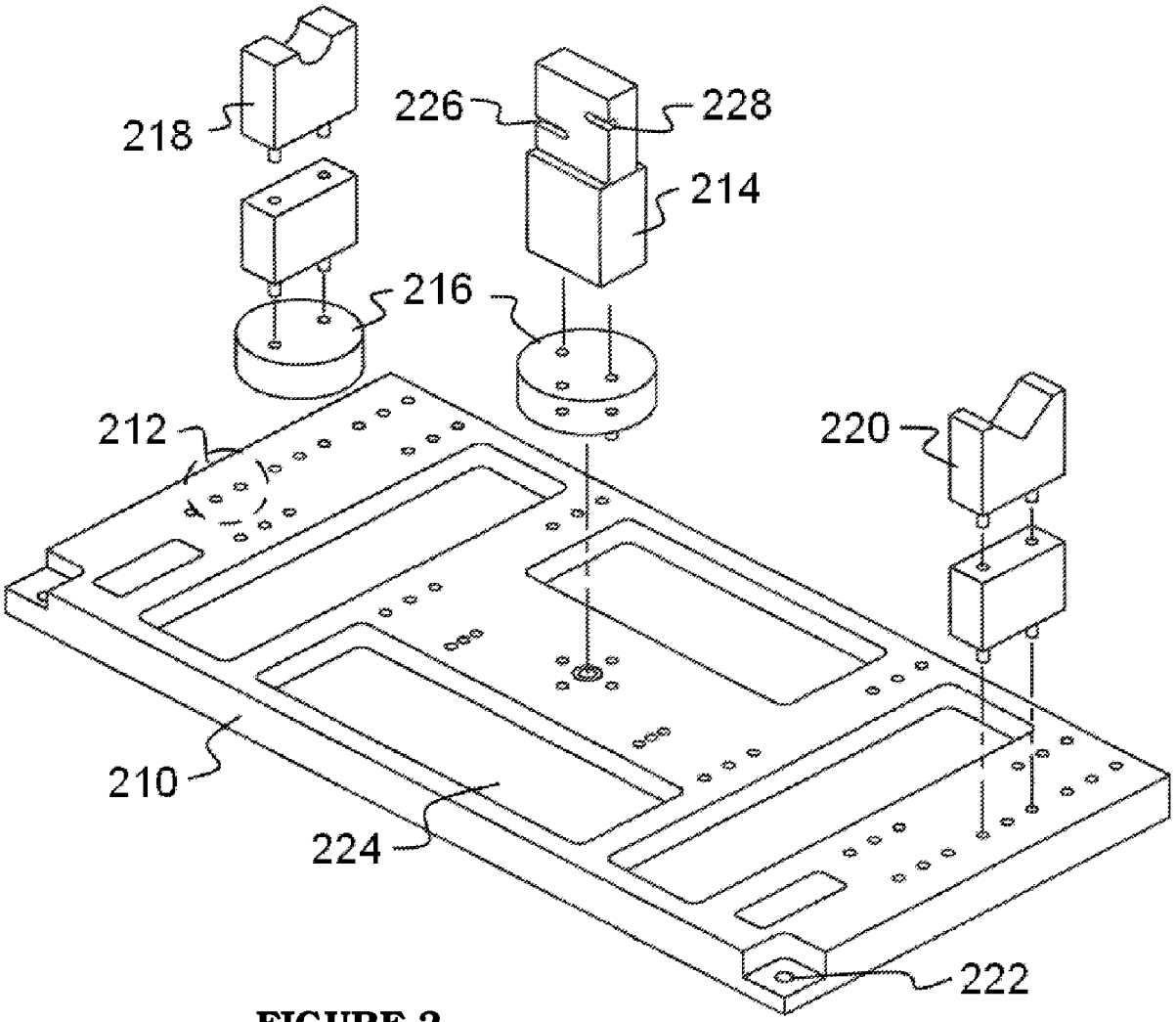
FIG. 2 shows features of an alternative embodiment according to the current disclosure.

FIG. 2 shows features of an alternative embodiment according to the current disclosure. A platform 210 includes multiple receivers 212 for receiving dowel pins. The receivers may be positioned in a variety of places on the platform 212. The use of multiple receivers 212 may allow for multiple firearms to be mounted at the same time on the same platform 210. One or more swivels 216 or rotational adapters may be insertable into the receivers 212 through the operation of a single dowel pin on a swivel 216 being inserted into one of the platform receivers 212. These swivels 216 may include receivers for coupling to a magazine mount 214.

The magazine mount may be shaped to conform to a magazine for a firearm and through the use of different shaped magazine mounts 214 a magazine fed weapon may be secured in place. The magazine mount 214 may include indents such as the grooves 226 and 228 which allow for certain weapons to catch the magazine mount 214 to effectuate securing, and a dowel pin (not shown) for insertion into receivers. For example and without limitation, the image shown as item 214 conforms to both AR type rifle magazines and M4 carbine type magazines and is therefore operable for insertion into the magazine compartment of those type of weapons. Other magazine mounts include mounts for:

the Smith & Wesson M&P series;
the Glock family of weapons;
the Heckler & Koch firearms;
the Model 1911 pistol;
Beretta;
M9;
Ruger, and
Walther.

Certain embodiments may have spacers/risers to lift and hold certain parts of a firearm in place. For example and without limitation a rounded or U cut riser 218 may be used to secure a barrel portion of a firearm whereas a V cut riser 220 may be used to hold the stock of a firearm. One having skill in the art will appreciate that different shaped risers may be effectuated for different types of firearms.

In some embodiments the platform 210 may have mounting holes 222 or screw holes or bolts (not shown) for securing the platform 210 to a fixture. An embodiment may also include compartments 224 for holding the risers and magazine mounts when not in use.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device including:

a platform, said platform having a plurality of receivers;

a substantially cylindrical rotational adaptor, said adaptor having a through-hole extending from a first base end through to a second base end, said adaptor also including an adapter pin disposed substantially in the center of the first base end, said pin extending into one of the receivers, and a magazine mount, said magazine mount having a substantially rectangular portion including a first indent region, said first indent region disposed on a corner of the magazine mount such that the first indent region extends on two sides of the magazine mount, and a second indent region disposed on a corner of the magazine mount such that the second indent region extends on two sides of the magazine mount.

2. The device of claim 1 wherein the adapter pin is disposed substantially near the center of the first base end.

3. The device of claim 1 wherein the plurality of receivers is arranged in an array.

4. The device of claim 3 where the array is two-dimensional.

5. The device of claim 1 wherein the magazine mount includes a curved portion.

6. A device including:

a platform, said platform having a plurality of receivers;

a rotational adapter, said adapter having a dowel pin extending from a first side, said dowel pin disposed into one of said receivers, said rotational adapter further including an adapter receiver;

a magazine mount, said magazine mount including a dowel pin angularly disposed on a surface of the magazine mount, said dowel pin disposed in the adapter receiver;

said magazine mount having a substantially rectangular portion;

said magazine mount including a first and second indent region, said first and second indent region disposed to extend onto two sides of the magazine mount.

7. The device of claim 6 wherein the magazine mount includes a curved portion.

* * * * *